US005700357A

United States Patent [19]

Didier

[11] Patent Number: 5,700,357

[45] Date of Patent: Dec. 23, 1997

[54] MECHANICAL BLANKET CLAMP IN ROTATING HEAD ASSEMBLY

[75] Inventor: James J. Didier, Beloit, Wis.

[73] Assignee: Beloit Technologies, Inc., Wilmington, Del.

[21] Appl. No.: 733,045

[22] Filed: Oct. 16, 1996

[51] Int. Cl.[6] ..... D21F 3/02

[52] U.S. Cl. ..... 162/358.3; 162/272; 492/22; 492/45

[58] Field of Search ..... 162/358.3, 361, 162/272; 492/22, 45, 47

[56] References Cited

U.S. PATENT DOCUMENTS

| | | | |
|---|---|---|---|
| Re. 33,034 | 8/1989 | Schiel et al. | 241/119 |
| 4,625,376 | 12/1986 | Schiel et al. | 29/119 |
| 4,673,461 | 6/1987 | Roerig et al. | 162/205 |
| 4,861,434 | 8/1989 | Bonander et al. | 162/358 |
| 4,944,089 | 7/1990 | Flamig et al. | 29/895.22 |
| 4,975,152 | 12/1990 | Filzen et al. | 162/358 |
| 5,011,578 | 4/1991 | Lange et al. | 162/358 |
| 5,098,523 | 3/1992 | Ilmarinen et al. | 162/358.3 |
| 5,141,601 | 8/1992 | Karlsson et al. | 162/358 |
| 5,167,768 | 12/1992 | Cronin et al. | 162/205 |

*Primary Examiner*—Karen M. Hastings
*Attorney, Agent, or Firm*—Dirk J. Veneman; Raymond W. Campbell; David J. Archer

[57] ABSTRACT

The Extended Nip press apparatus of this invention has an endless loop nip blanket which is clamped at each end head by a circular array of twelve clamp segments which are positioned radially by the hydraulic actuation of an axially positionable circumferential clamp ring. The blanket is separately sealed by an air tube seal which extends between the clamp ring and the interior of the blanket. Because the clamping arrangement is independent of the seal, inadvertent loss of air pressure will not cause the blanket to become unclamped.

34 Claims, 6 Drawing Sheets

MECHANICAL BLANKET CLAMP IN ROTATING HEAD ASSEMBLY

FIELD OF THE INVENTION

This invention relates to an Extended Nip press apparatus for pressing water from a web of paper. More particularly, the present invention relates to an "apple" type enclosed Extended Nip press in which lubricant disposed between the press shoe and the blanket is enclosed or contained within the blanket. Still more particularly, the present invention relates to the construction of the blanket end seal in such an apparatus.

BACKGROUND OF THE INVENTION

Presses which employ a concave shoe engaged against a backing roll, such as the Extended Nip® press manufactured by Beloit Corporation of Beloit, Wis., are used in a papermaking machine for increasing the residence time of a web during passage of the web through a pressing nip. Typically, a nip is thought of as the narrow region about the line of co-tangency when two rolls with aligned axes are brought together. The nip between rolls has classically been used in papermaking to remove water and to compress the fibers in the paper web into a smooth surface. In papermaking it has been found to be desirable to increase the area of the nip and so subject the paper web to a somewhat lower pressure, more uniform pressing in which more heat transfer between the roll and the paper can take place. In some circumstances, the length of the nip can be increased by coating the surface of one or both of the rolls with a compliant material. The use of a compliant roller allows for nips somewhat greater than an inch in length along the direction of the web through the nip.

The desire for even longer nips led to the development of the so-called Extended Nip press (ENP). The ENP employs a backing roll and an elongated shoe which has a concave surface which matches the convex surface of the backing roll and cooperates with the roll over a length on the order of ten inches along the direction of travel of the paper web. The shoe, which forms one-half of the nip, is stationary. Without further modification, a paper web moving through the nip formed between the shoe and the backing roll would experience unacceptable rubbing on the non-moving shoe. To overcome this problem, a bearing blanket forming a cylindrical tube is slidably disposed over the shoe and around the support shaft on which the shoe is mounted. Friction between the bearing blanket and the shoe is greatly reduced due to the presence of an oil film which is supplied between the nip and the backside of the blanket. The blanket thus freely slides on an oil film on the shoe.

To aid in the drying or pressing of the paper web, a felt or blanket often underlies and supports the paper web as it transits the nip between the backing roll and the bearing blanket on the shoe. The backing roll, the paper web and the web support blanket, if present, are frictionally engaged and in turn engage the upper surface of the bearing blanket, causing it to slide over the shoe and to rotate about the shoe and its support shaft.

On one type of Extended Nip press the bearing blanket is tensioned and supported by rolls which result in open ends to the cylindrical blanket. The open end of the bearing blanket causes a problem with oil contamination of the web. There is a tendency for lubricating oil disposed between the shoe and the blanket to creep around the edges of the blanket so that the press felt and the paper web become contaminated. The fine oil dispersion which may result on surrounding equipment is also undesirable. The solution has been to seal the ends of the blanket to two rotating heads which are mounted on the shoe support shaft. The edges of the bearing blanket are extended beyond the shoe where they are free to take on a circular cross section which may be sealed or joined to the disc shaped rotating heads.

The cross-section of the blanket at the heads is circular, but the cross-section taken through the nip between the shoe and the backing roll has an appearance somewhat similar to an apple in cross-section. The shape of the blanket is circular, with a concave, dimpled surface where the stem of an apple would be. Thus, as the press blanket moves through the nip, it is elastically deformed. More particularly, between the ends of the nip and the ends of the blanket, the material of the blanket forms a compound curve as the blanket transits from the shape of the nip to the circular ends of the blanket where they are attached to the rotating head assemblies. As a result of the compound curve flexure and the resultant wear in the blanket the blanket must be periodically replaced.

A typical papermaking machine of which the Extended Nip press forms a part may produce over half a million square feet of paper an hour. Thus, downtime is costly and the method of clamping the blanket to the rotating head assemblies must be compatible with rapid and precise replacement of the blanket.

One approach to forming the seal between the blanket and the heads has been to use a peripheral air seal tube to both clamp the blanket to the head and to provide a seal against escape of the interior oil. However, a drawback to this approach is that loss of air pressure to the air seal tube not only results in a violation of the oil containment, but a loss of clamping engagement between the blanket and the heads, with the possibility of damage to the blanket and other equipment.

What is needed is a blanket-to-head clamping device which is easily installed and removed, and which maintains a clamping engagement in the event of loss of seal.

SUMMARY OF THE INVENTION

The Extended Nip press apparatus of this invention has an endless loop nip blanket which is clamped to press heads by an array of clamp segments with inclined surfaces which are driven hydraulically to ride against the wedge surface of a circumferential clamp ring. This radially outward movement of the clamp segments mechanically clamps the blanket against the clamp ring. Once the clamp segments have been hydraulically driven into clamping engagement, they are held in place with bolts. The interior of the blanket is separately sealed against escape of oil by an air tube seal which extends between the clamp ring and the interior of the blanket. Because the clamping arrangement is independent of the seal, inadvertent loss of air pressure will not cause the blanket to become unclamped.

Both hydraulic pressure for clamping and releasing the blanket, and air pressure for sealing the blanket to the clamp ring, are provided from sources exterior to the head ends, with the hydraulic and pneumatic inlets sealed during press operation.

It is feature of the present invention to provide a blanket end seal which decreases the down time associated with replacing the shoe blanket.

It is another feature of the present invention to provide a seal for an Extended Nip blanket which is air and oil tight.

It is also a feature of the present invention to provide an Extended Nip blanket which remains clamped to the press heads even when air pressure to the rotating seal is lost.

It is an additional feature of the present invention to provide a mechanical clamping apparatus for retaining an Extended Nip blanket to the heads.

Further objects, features and advantages of the invention will be apparent from the following detailed description when taken in conjunction with the accompanying drawings.

DESCRIPTION OF THE PREFERRED EMBODIMENT

Figure 1:
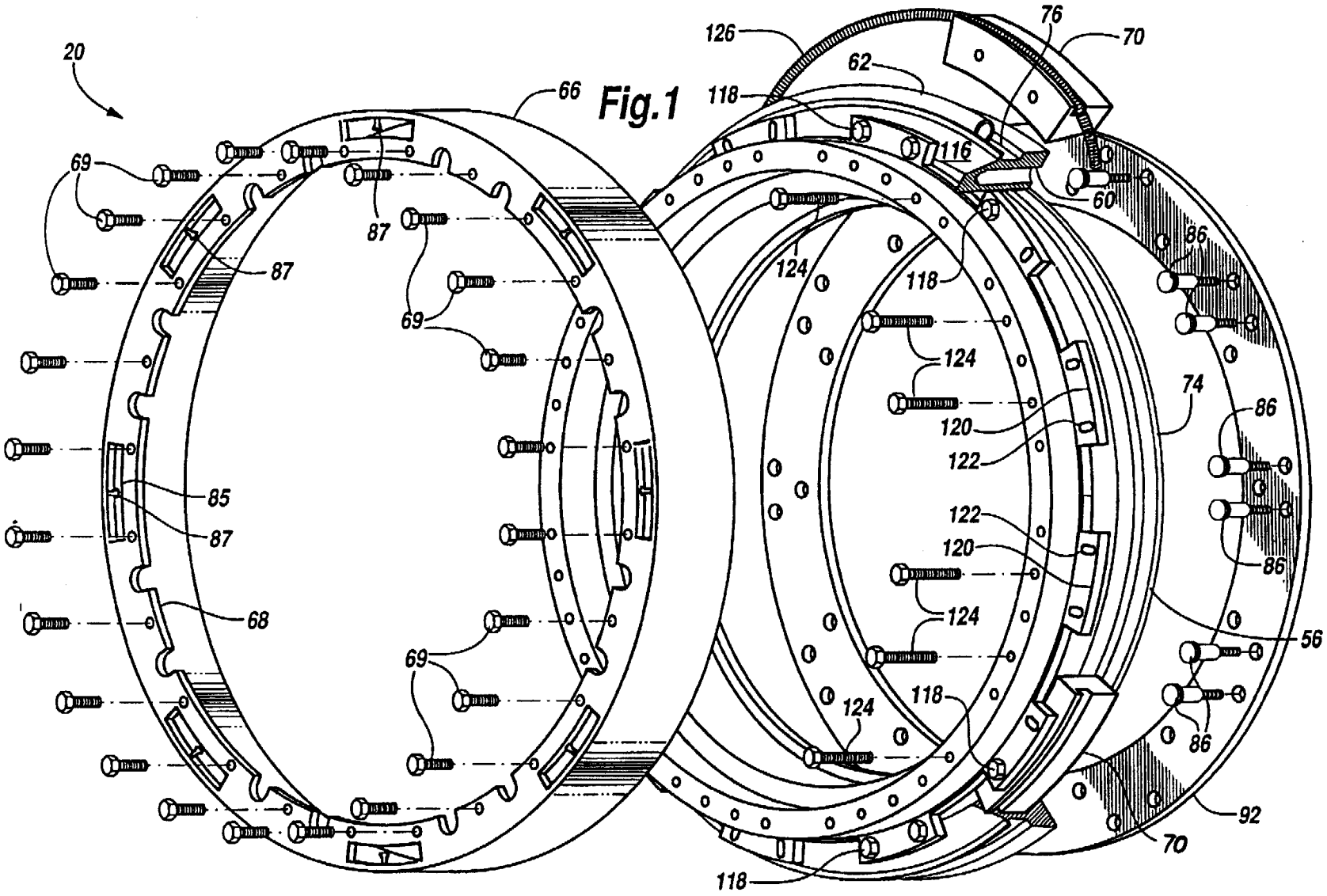
FIG. 1 is a partial exploded isometric view of the clamping and sealing assembly for an Extended Nip press of this invention.
Figure 2:
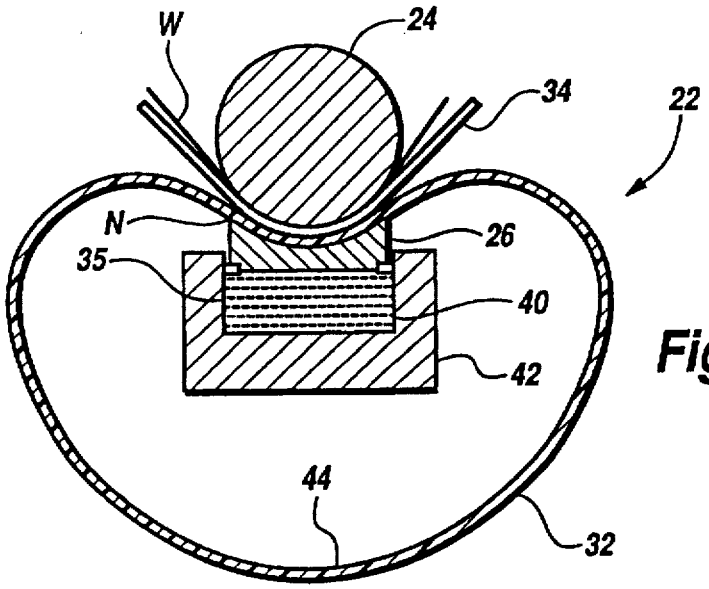
FIG. 2 is a schematic view of the Extended Nip press of this invention.

Referring more particularly to FIGS. 1–10, wherein like numbers refer to similar parts, an Extended Nip blanket clamping and sealing apparatus 20 is shown in FIG. 1. As shown in FIG. 2, an Extended Nip press 22 has a backing roll 24 mounted to a press frame (not shown) which is opposed to a shoe 26. The shoe 26 has a concave surface which conforms to the cylindrical surface of the backing roll 24 and forms a nip N between the backing roll 24 and the shoe 26. The nip, which may typically be about ten inches long, forces a paper web into extended and high pressure contact with the press roll. The extended high pressure passage through the nip is advantageously used in presses, impulse dryers, and the like, to speed the removal of water and drying of a paper web in a papermaking machine. In order to lower the friction between the paper web or its backing felt and the shoe, a lubricated endless blanket 32 is passed over the concave surface of the shoe. The blanket 32 extends through the nip N between the roll 24 and the shoe 26. The inside surface of the blanket, which rides on the concave surface of the shoe, is lubricated with oil to form a compressed oil film on which the blanket rides. In the modern, high speed papermaking machine, where the paper web may move at 3,000 feet per minute, the nip blanket will also move at 3,000 feet per minute, and generate a spray of oil droplets on the downstream side of the shoe. These oil droplets, if free to escape from the interior of the blanket, can contaminate the paper web and the machine vicinity. To seal the interior of the blanket, the ends of the blanket of this invention are sealed to rotatably mounted heads. The press felt 34 passes over the blanket 32, and a paper web W is supported on the felt as the blanket 32, felt 34, and web W pass through the nip N. The shoe 26 is supported and urged against the surface of the roll 24 by a hydraulic piston 35 which moves in a piston cavity 40. The piston cavity 40 is formed in a non-rotating support beam 42.

Figure 4:
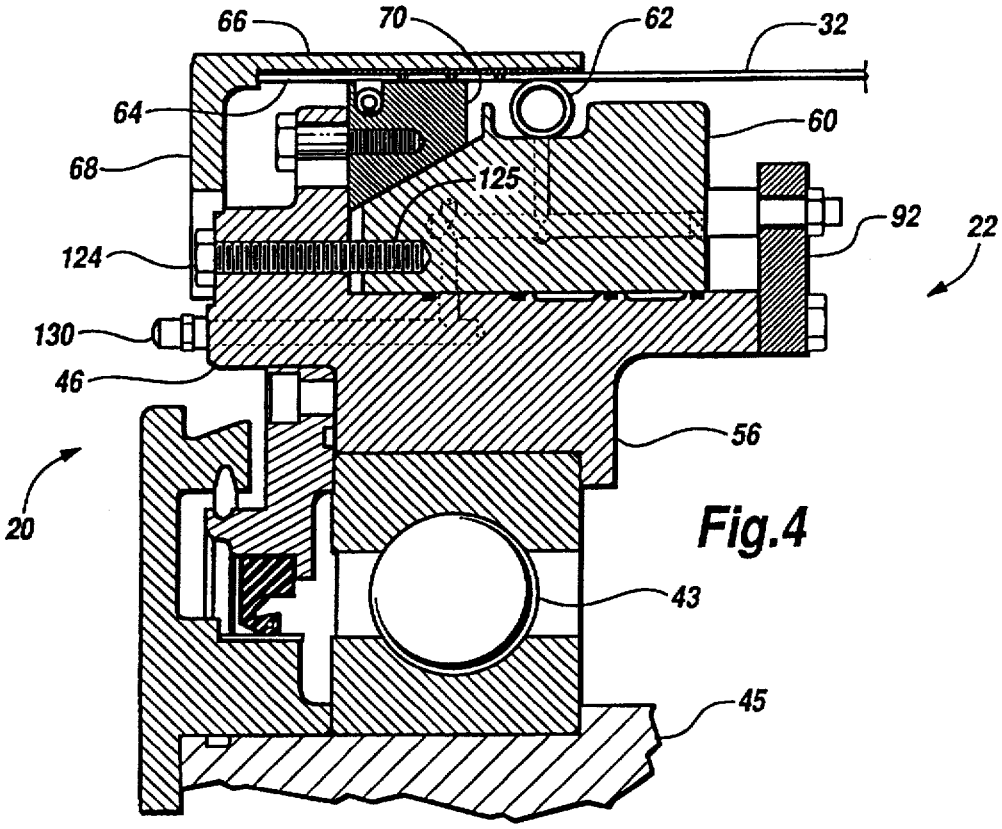
FIG. 4 is a fragmentary cross-sectional view of the mechanical clamping and sealing assembly of FIG. 1 shown in a blanket engaged and clamped position with clamp ring bolts engaged to the head.

The Extended Nip press 22 is utilized in the pressing and drying of the paper web in the pressing and drying sections of a papermaking machine. The blanket 32 has a characteristic apple shape caused by its path through the nip N. The passage of the blanket 32 over the concave surface of the shoe 26 is facilitated by a film of oil (not shown) which supports and lubricates the blanket's passage through the nip N. The blanket 32 may be supported in its movement on side shoes, such as is disclosed in U.S. Pat. No. 4,673,461 to Roerig et al., the disclosure of which is incorporated by reference herein. This lubricating oil tends to escape from the interior 44 of the blanket 32 unless the ends of the blanket are enclosed. In addition to preventing the escape of lubricating oil, a closed end Extended Nip press is able to hold pressure, typically one-half to one pound per square inch, within the blanket 32. By pressurizing the blanket 32 the shape of the blanket is better maintained, The closure of the blanket 32 is simplified by extending it beyond the ends of the backing roll 24 so that it can be made to conform to a circular cross-section and thus be sealed by circular head ends 46, as shown in FIG. 4. The head ends 46 are rotatably mounted on bearings 43 to stationary supports 45. These in turn are mounted to the shoe support beam 42.

Figure 3:
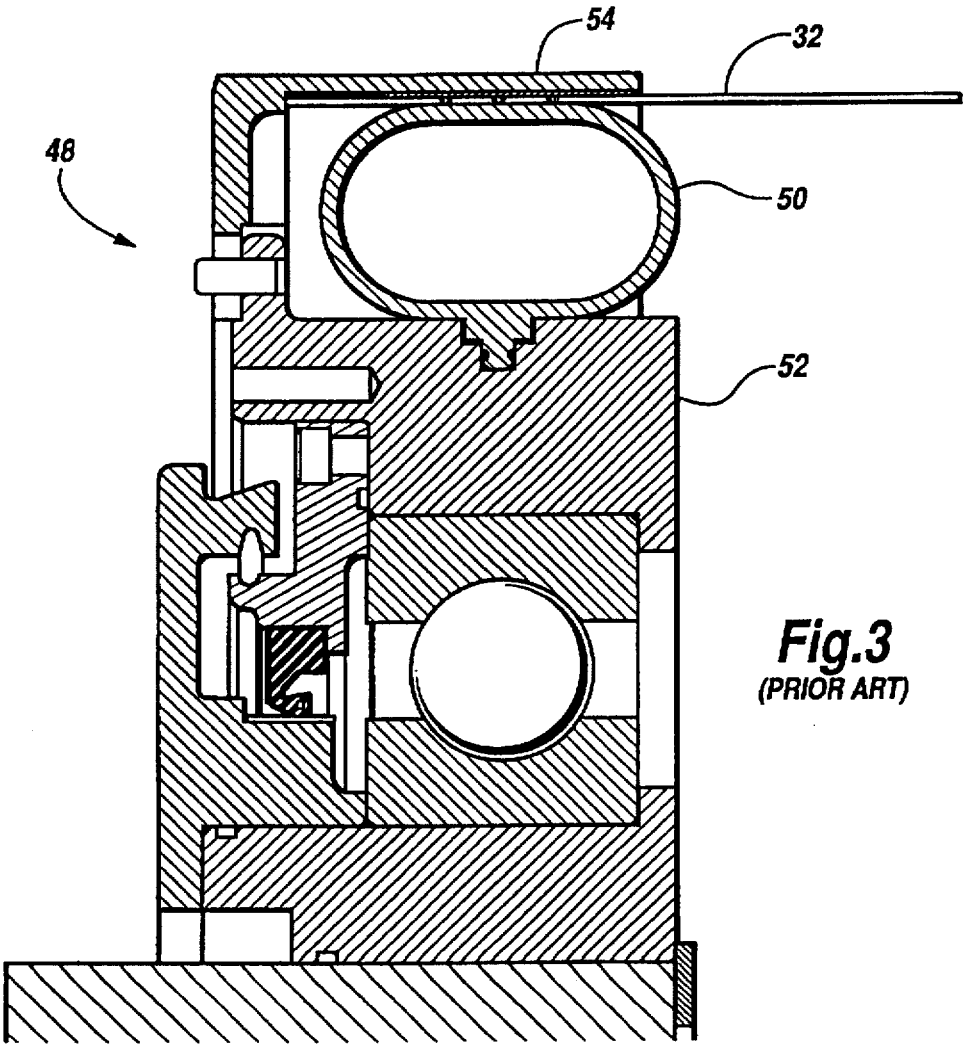
Fig.3 (PRIOR ART)
FIG. 3 is a fragmentary cross-sectional view of a prior art air tube clamping arrangement for an Extended Nip press.

A prior art head-to-blanket end seal arrangement 48, shown in FIG. 3, has a peripheral air tube 50 which is inflatable to extend between the head 52 and the blanket 32 to clamp the blanket against a circumferential head ring 54. The air tube 50 in such an arrangement serves two purposes—clamping the blanket 32 to the head 52, and forming a seal against the escape of oil from the interior. The head-to-blanket end seal arrangement 20 of the present invention provides a back-up against inadvertent failure of the seal by utilizing a mechanical clamp which is separate from the pneumatic seal. Hence loss of the seal at the ends of the Extended Nip press will not result in separation of the blanket from the press.

The extended nip press 22 of this invention, has two heads 56. One head 56 is positioned on each end of the blanket, with the heads 56 spaced from one another in the cross machine direction. Although the operation of a single side of the clamping and sealing apparatus 20 is discussed below, it is to be understood that like structure and operating steps are provided at both ends of the blanket 32. As shown in FIG. 4, each head 56 is rotatably mounted on bearings 43 to the bearing support. A one-piece generally cylindrical clamp ring 60 is mounted to each head 56. An air seal tube 62 is mounted to the clamp ring 60 and is inflatable to extend radially outwardly and to seal the blanket 32 against the interior surface 64 of a flanged cylindrical head ring 66. The head ring 66 is substantially coaxial with the head and has portions which encircle the wedge segments 70. The flange 68 of the head ring 66 is fixed to the head 56 by bolts 69, shown in FIGS. 1 and 5. Twelve clamp wedge segments 70, shown in FIG. 1, are mounted to the head 56 for radial displacement, and are simultaneously driven radially outwardly by axial displacement of the clamp ring 60 to clamp the blanket 32 to the head ring 66. In the Extended Nip press operating condition, shown in FIG. 4, the air tube 62 is fully inflated and sealed, and the wedge segments 70 are extended and held in their blanket clamping positions by removable bolts 124 which extend between the head end 46 and the clamp ring 60.

Figure 5:
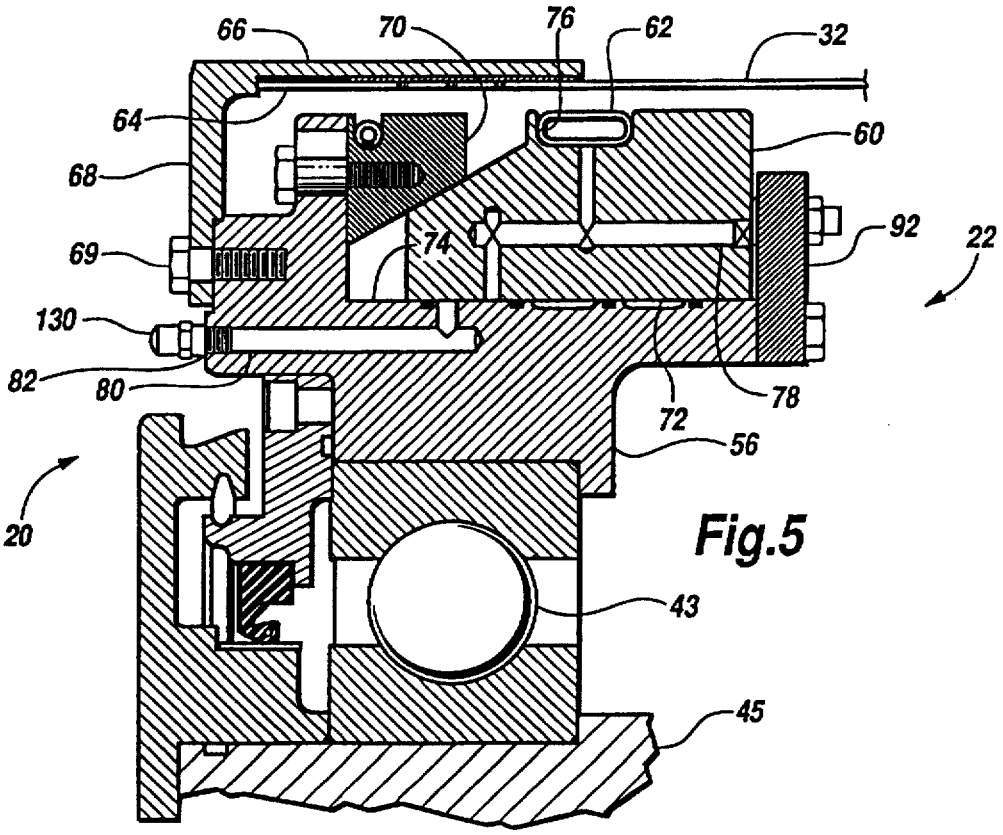
FIG. 5 is a fragmentary cross-sectional view of the mechanical clamping and sealing assembly of FIG. 1 shown in a blanket release position.

As shown in FIG. 5, in the blanket unclamped and unsealed position of the press 22, the air seal tube 62 is deflated and the clamp wedge segments 70 are withdrawn from engagement with the blanket. It is in this position that a worn blanket 32 is removed from the press, and a fresh blanket is inserted after removing the head ring 66 from one end. The clamp ring 60 is coaxial with the head 56 and has a generally cylindrical interior sliding surface 72 which engages slidably for axial displacement on the cylindrical exterior surface 74 of the head 56. Hydraulic fluid and compressed air are introduced into and removed from the clamp ring 60 at the interface between the interior sliding surface 72 and the exterior head surface 74.

The air seal tube 62 is received on the clamp ring 60 and held in place within a circumferential groove 76. A compressed air passage 78 is machined into the clamp ring 60. The air passage 78 is comprised of three intersecting blind holes which define a conduit for compressed air ding surface 72 to the air tube 62 within the groove 76. A head air passage 80 extends from an air inlet 82 on the outward face of the head 56. In the unclamped configuration, the head air passage 80 is not in communication with the clamp ring air passage 78 and thus no compressed air may be supplied when the blanket is not clamped.

Figure 6:
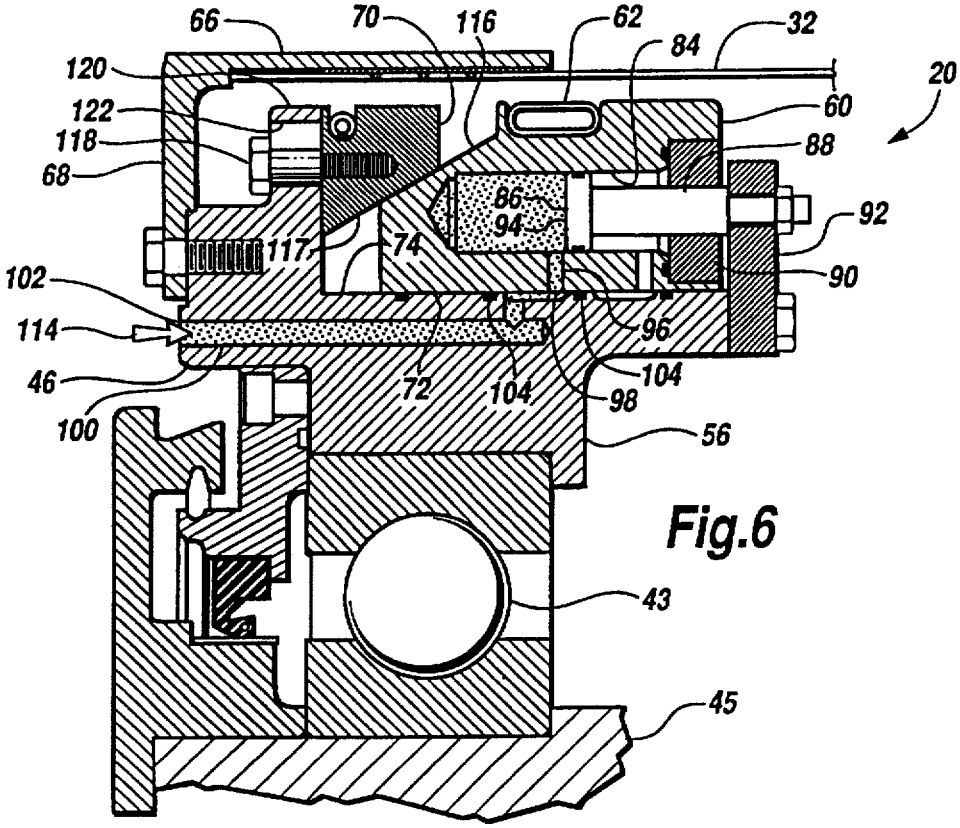
FIG. 6 is a fragmentary cross-sectional view of the mechanical clamping and sealing assembly of FIG. 1 showing the supply of hydraulic fluid to the clamp.

Once the blanket 32 has been positioned to extend between the two head ends 46, and is positioned at each end with each lateral edge of the blanket between the head ring 66 and the clamp wedge segments 70, as shown in FIG. 6, the head assembly is ready to be clamped. For convenience in initially positioning the blanket 32, the blanket may be provided with tabs 83, shown in FIG. 7, which extend through curved slots 85 opening sidewardly on the head ring 66. The tabs 83 may be pinned in place during the clamping operation by positioning slits in the blanket tabs over pins 87 which extend within the curved slots 85.

As shown in FIG. 6, twenty-four piston cylinders 84 are bored in the clamp ring 60. The piston cylinders 84 extend axially, and are positioned so there are two cylinders 84 for each clamp wedge segment 70. A cylindrical piston 86 extends within each piston cylinder 84. Each piston 86 has a shaft 88 which extends through a threaded plug 90 and outside the clamp ring 60 where it is fixed to an annular inward plate 92 which is bolted to the head 56. O-rings form a seal between the plugs 90 and the clamp ring 60. A piston head 94 with an encircling O-ring is fixed to each piston shaft 88 to form a fluid-tight seal with the piston cylinder 84 as the clamp ring 60 moves axially.

Each piston 86 and piston cylinder 84 functions as part of a double acting actuator. A clamping hydraulic fluid passage 96 extends from the cylinder 84 inward of the piston head 94 to the clamp ring interior sliding surface 72. The clamping hydraulic fluid passage 96 communicates with a circumferential groove 98 formed in the head 56 and opening on the head exterior surface 74. The groove 98 extends axially and is wider than the diameter of the clamping hydraulic fluid passage 96 in the clamp ring 60. The groove 98 is sufficiently wide that it will remain in communication with the inlet hydraulic fluid passage 96 as the clamp ring 60 travels from an unclamped to a clamped position. A hydraulic fluid passage 100 is formed in the head 56 extending from the groove 98 to a hydraulic fluid inlet 102 on the outward face of the head. The interface between the head 56 and the clamp ring 60 is sealed on either side of the groove 98 by O-rings 104.

Figure 8:
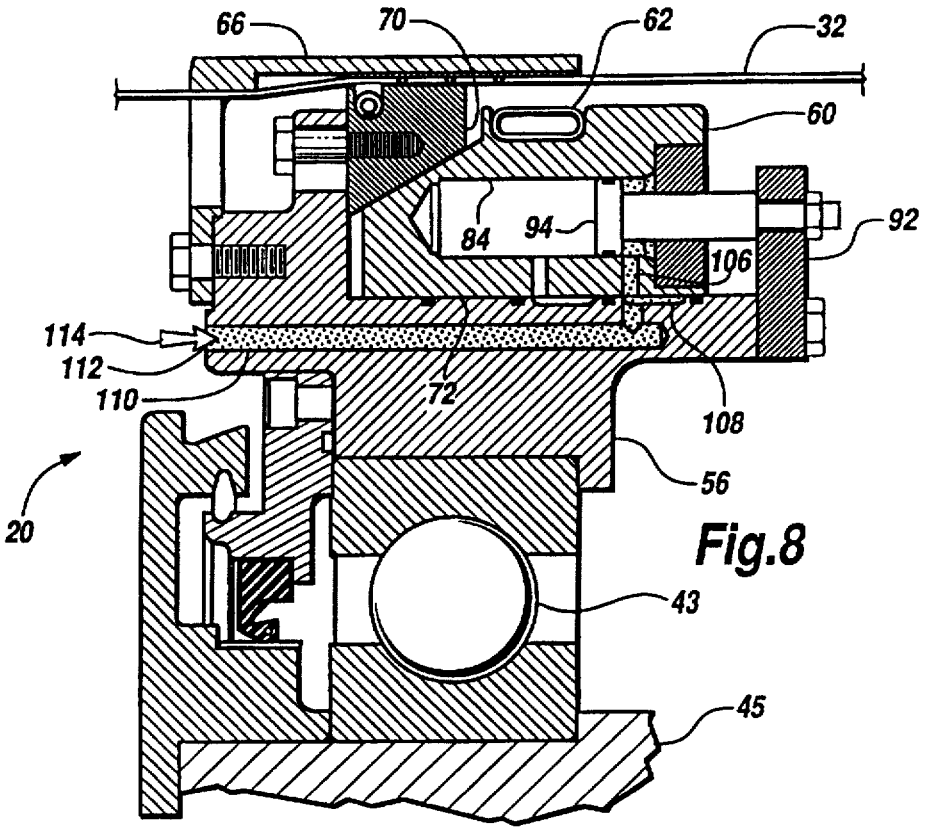
FIG. 8 is a fragmentary cross-sectional view of the mechanical clamping and sealing assembly of FIG. 1 showing the supply of hydraulic fluid to unclamp the apparatus.

As shown in FIG. 8, an unclamping hydraulic fluid passage 106 extends from the piston cylinder 84 inward of the piston head 94 and opens on the clamp ring sliding surface 72 where it communicates with a second circumferential groove 108 in the head 56. The groove 108 is wider than the diameter of the unclamping hydraulic fluid passage 106 so as to remain in communication with the passage 106 throughout the axial travel of the clamp ring 60 during unclamping. The second groove 108 connects with an unclamping hydraulic fluid passage 110 in the head 56 which communicates with an unclamping hydraulic fluid inlet 112. The unclamping fluid inlet 112 is displaced from the clamping fluid inlet 102.

Figure 7:
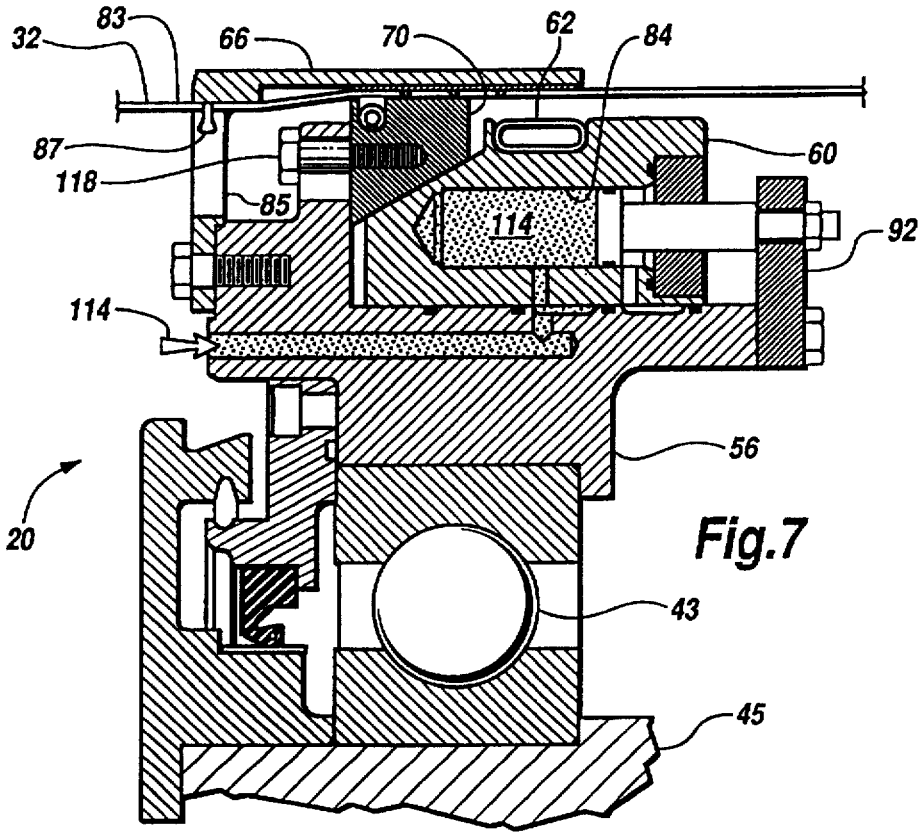
FIG. 7 is a fragmentary cross-sectional view of the mechanical clamping and sealing assembly of FIG. 1 in a clamped, but unsealed position.

To clamp the blanket 32 to the head rings 66, a hydraulic fluid line is connected to each stationary head 56 at the clamping hydraulic fluid inlet 102, and, as shown in FIGS. 6 and 7, hydraulic fluid 114 is pumped through the passage 100 in the head 56 to the circumferential groove 98 where the fluid is distributed to all twenty-four clamp ring passages 96 and to the piston cylinders 84. As the piston cylinders 84 are filled with hydraulic fluid 114, the clamp ring 60 is uniformly driven axially outward and away from the piston heads 94. An inclined frustoconical surface 116 is formed on the outwardly facing exterior part of the clamp ring 60. The inclined surface 116 engages with similarly inclined frustoconical surfaces 117 on the interior inwardly facing part of the clamp wedge segments 70. The radius of the inclined surface 117 on the clamp wedge segment 70 should closely match the inclined surface 116 on clamp ring 60 when in the clamped position.

In a preferred embodiment the surfaces of the clamp wedges and the clamping ring mate with each other to remain engaged throughout the travel of the wedges with respect to the clamp ring. The surfaces may be both roughly frustoconical, or alternatively the clamp ring may be formed with inclined planar segments which mate with inclined planar sections of the wedge segments. Other ramped geometries may also be employed.

As shown in FIGS. 1, 6 and 7, each clamp wedge segment 70 is connected to the head 56 by two shoulder screws 118 which extend through ears 120 which extend radially outwardly from the head 56. Each of the two shoulder screws 118 for a single clamp wedge segment 70 extends through a slot 122 in the same ear 120. The two slots 122 for a wedge segment 70, although extending generally radially outwardly, are parallel to one another, so that the connected clamp wedge segment 70 is free to move radially, while being prevented from axial movement.

As hydraulic fluid 114 is pumped into the piston cylinders 84 the clamp ring 60 moves steadily axially outwardly, driving the clamp wedge segments 70 radially toward the exterior of the head 56 until the clamp wedge segments 70 engage and clamp the blanket 32 against the head ring 66, as shown in FIG. 7. The head ring 66 is preferably provided with inwardly protruding gripper teeth which engage with the blanket. The gripper teeth may be formed by depressing a generally conical punch into a cylindrical sheet of metal, which is then connected to the head ring 66.

Once the clamp wedge segments 70 are in the desired clamping position, sixteen fasteners 124 are passed through the head 56 and screwed into the clamp ring 60 as shown in FIGS. 1 and 4. As the clamp ring 60 is oriented by the pistons 86, the tapped holes 125 for the fasteners 124 will always be properly aligned, regardless of the axial position of the clamp ring 60. With the clamp ring 60 engaged to the head 56 by the fasteners 124, the pressure on the pistons 86 is released and the clamping hydraulic fluid inlet 102 is plugged. There is no pressure on the pistons 86 while the apparatus 20 is in operation.

Figure 10:
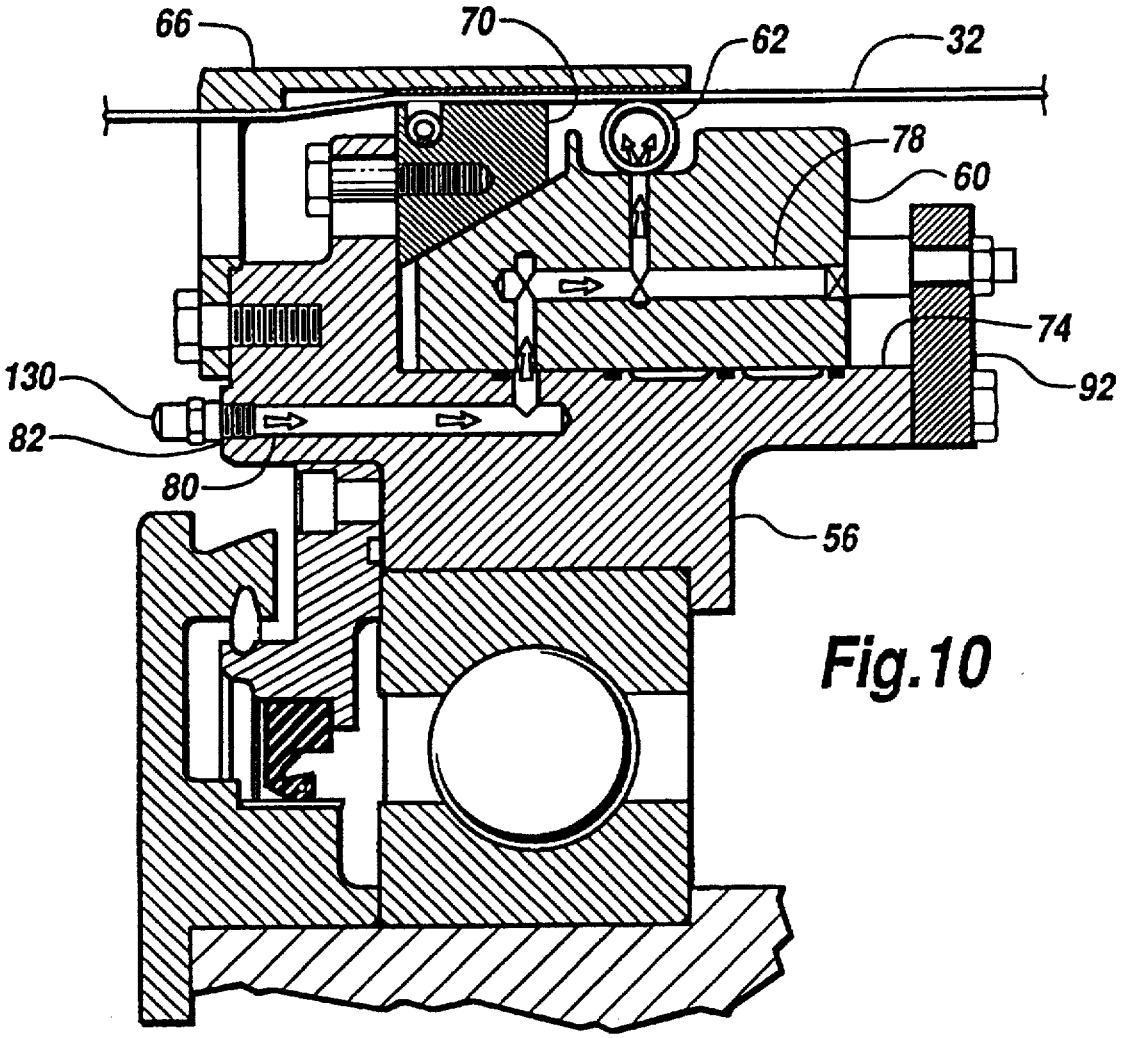
FIG. 10 is a fragmentary cross-sectional view of the mechanical clamping and sealing assembly of FIG. 1 showing the supply of pressurized air to inflate and seal the assembly.

Although the clamp wedge segments 70 securely connect the blanket 32 to the head 56, they do not form a complete seal. As shown in FIG. 10, the seal is implemented by introducing compressed air through the air inlet 82 in the head 56. The air inlet 82 is con at the head exterior surface 74. When the clamp ring 60 is in a clamped position the head air passage 80 communicates with the air passage 78 in the clamp ring 60. The head air passage 80 is larger in diameter than the mating clamp ring air passage 78 where the two come together, to accommodate variations in clamp ring axial position when clamped. The air flows from the clamp ring air passage 78 to the air seal tube 62 which extends circumferentially around the clamp ring 60 and which forms a seal between the blanket 32 and the clamp ring.

With the blanket properly clamped and a seal obtained, the Extended Nip press 20 may now be operated until it is necessary to adjust or replace the blanket 32. The air inlet 82 is sealed with a schrader valve and cap 130, and pressure is retained in the seal tube 62 while the apparatus 20 is in operation.

Figure 9:
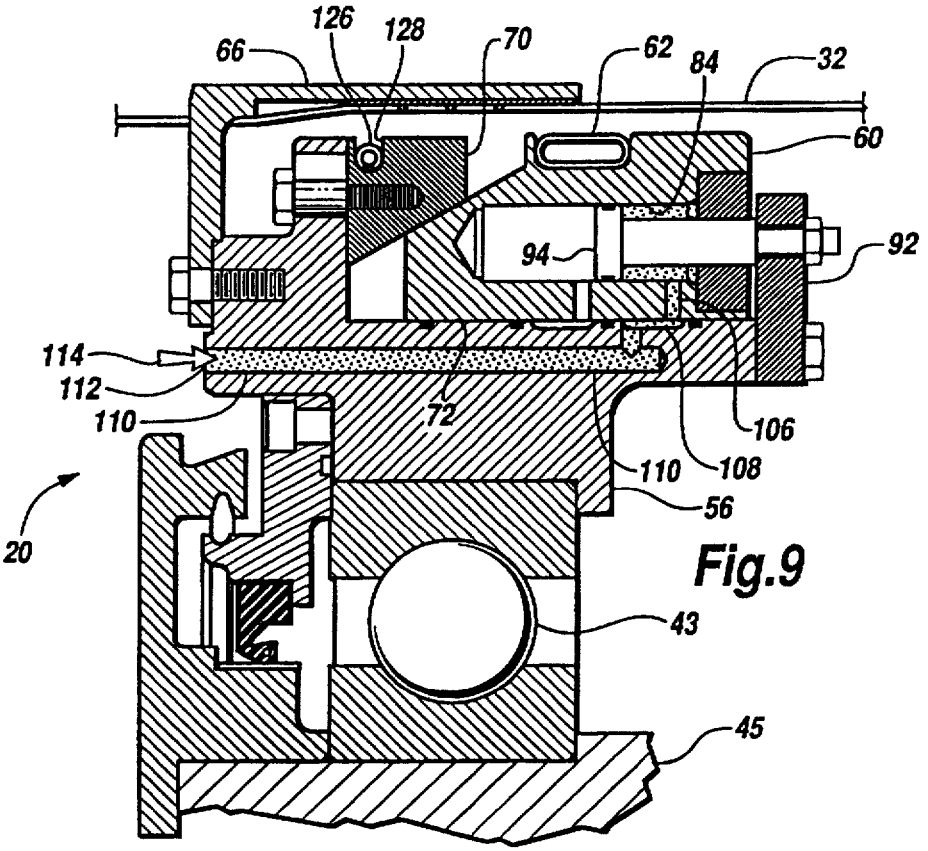
FIG. 9 is a fragmentary cross-sectional view of the mechanical clamping and sealing assembly of FIG. 1 showing the hydraulic fluid supplied to fully unclamp the apparatus.

When it is desired to unclamp the blanket 32, the air seal tube 62 is deflated, the fasteners 124 which hold the clamp ring 60 to the head 56 are removed, and hydraulic fluid is introduced through the unclamping hydraulic fluid inlet 112, as shown in FIGS. 8 and 9. The hydraulic fluid 114 passes through the unclamping hydraulic fluid passage 110 in the head 56 to the groove 108 and then through the unclamping hydraulic fluid passages 106 in the clamping ring to all the piston cylinders 84. The unclamping hydraulic fluid acts on the clamping ring 60 to displace it axially inwardly. As shown in FIG. 1 and in FIG. 9, a circumferential coil tension spring 126 extends within exterior facing slots 128 on each clamp wedge segment 70. The slots prevent the spring 126 from impinging on the blanket 32 when clamped. The spring 126 serves to draw the clamp wedge segments 70 radially toward the interior when the clamp ring 60 is moved axially inwardly by the unclamping hydraulic fluid. When fully unclamped the pressure may be released on the pistons 86, and operations may proceed on the blanket 32.

It will be observed that in addition to providing convenient insertion and removal of blankets, the apparatus 20 provides for the eventuality of loss of air pressure to the air seal tube 62. Should air pressure be lost to the air seal tube 62 when the press apparatus 20 is in operation, such as by a puncture, oil may leak from the apparatus 20, but the blanket will remain clamped to the heads 56, avoiding further equipment damage.

It should be noted that greater or lesser number of clamp wedge segments may be employed.

It is understood that the invention is not limited to the particular construction and arrangement of parts herein illustrated and described, but embraces such modified forms thereof as come within the scope of the following claims.

What is claimed is:

1. A press apparatus for a papermaking machine comprising:

a rotatably mounted backing roll;

an elongated concave shoe, the shoe being urged toward the backing roll to define an extended nip therebetween for the passage therethrough of a paper web;

a blanket defining an endless loop, wherein the blanket extends through the nip such that the web is disposed between the blanket and the backing roll, the blanket having a first lateral edge and a second lateral edge spaced in the cross machine direction from the first lateral edge;

at least one head mounted for rotation about an axis with respect to the shoe, wherein the head has an outwardly facing generally cylindrical surface;

a clamp ring having an inwardly facing generally cylindrical surface adjacent the head outwardly facing cylindrical surface, the clamp ring being coaxial with the head, and mounted on the head for axial displacement thereon;

portions of the clamp ring which define a generally frustoconical wedge surface spaced radially outwardly from the clamp ring inwardly facing surface;

a plurality of wedge segments engaged with the clamp ring wedge surface, wherein each wedge segment has an inclined surface which engages with the clamp ring wedge surface such that axial displacement of the clamp ring with respect to the head causes the simultaneous radial displacement of all wedge segments; and a generally cylindrical head ring which is substantially coaxial with the head and which has portions which encircle the wedge segments, and which is fixed to the head, wherein portions of the blanket extend between the wedge segments and the head ring, and wherein the clamp ring is selectably positionable to alternatively cause the wedge segments to fixedly clamp the blanket to the head, and to release the blanket from engagement with the head for removal from the apparatus.

2. The press apparatus of claim 1 wherein each wedge segment is connected to the head by two fasteners, wherein the fasteners extend through two parallel slots defined by portions of the head, such that the wedge segment is slidable radially outwardly with respect to the head, while being retained against substantial axial displacement by the fasteners.

3. The press apparatus of claim 1 wherein each wedge segment has portions defining an outwardly facing peripheral slot, and further comprising a looped extension spring which encircles all the wedge segments and urges said wedge segments into contact with the clamp ring.

4. The press apparatus of claim 1 further comprising:

a plurality of pistons connected to the head, wherein the pistons are parallel to the axis of the head; and portions of the clamp ring which define piston cylinders, each piston cylinder opening toward and receiving a piston therein for sliding movement of the clamp ring with respect to the pistons and the head.

5. The press apparatus of claim 4 further comprising:

portions of the head which define a first groove which encircles the head and which opens on the outwardly facing generally cylindrical head surface;

portions of the clamp ring defining first passages, wherein a first passage extends from each piston cylinder to the inwardly facing generally cylindrical surface of the clamp ring, the first passages communicating with the first groove on the head; and a first hydraulic fluid inlet defined by portions of the head, the first inlet being in communication with the first groove, such that hydraulic fluid may be introduced into the first passages and the piston cylinders to act on the pistons and drive the clamp ring axially toward the wedge segments.

6. The press apparatus of claim 5 further comprising:

portions of the head defining a second groove which encircles the head and which opens on the outwardly facing generally cylindrical head surface;

portions of the clamp ring defining second passages, wherein a second passage extends from each piston cylinder to the inwardly facing generally cylindrical surface of the clamp ring, the second passages communicating with the second groove on the head; and a second hydraulic fluid inlet defined by portions of the head, the second inlet being in communication with the second groove, such that hydraulic fluid may be introduced into the second passages and the piston cylinders to act on the pistons to drive the clamp ring axially away from the wedge segments.

7. The press apparatus of claim 1 further comprising an air tube which encircles the clamp ring, wherein the air tube is inflatable when the clamp ring is in the blanket clamped position to form a seal between the clamp ring and the blanket.

8. The press apparatus of claim 7 further comprising:

portions of the clamp ring which define an air passage which extends between the air tube and the inwardly facing generally cylindrical surface of the clamp ring;

portions of the head which define an air inlet passage which communicates between the clamp ring air passage and the head exterior when the clamp ring is in a blanket clamped position, such that pressurized air may be introduced into the air tube from the exterior of the head.

9. The press apparatus of claim 8 wherein the air inlet passage as it discharges to the outwardly facing generally cylindrical surface of the head is larger in diameter than the mating air passage in the clamp ring where the air inlet passage communicates with the clamp ring air passage, thereby accommodating a range of clamped positions of the clamp ring.

10. The press apparatus of claim 1 wherein the head ring has a radially extending flange, and wherein the flange is connected to the head by a plurality of removable fasteners.

11. The press apparatus of claim 1 further comprising a plurality of removable fasteners which extend through portions of the head into the clamp ring, the fasteners serving to hold the clamp ring in an axial blanket clamped position, wherein the fasteners are removable to permit the clamp ring to be displaced axially to a blanket unclamped position.

12. A press apparatus for use in a papermaking machine, comprising:

a backing roll rotatably mounted to a machine frame;

an elongated nip shoe fixed to the machine frame and having a concave surface which is urged against the backing roll to define a nip with the backing roll to engage a paper web between the nip shoe and the backing roll;

a blanket which extends through the nip such that the web is disposed between the blanket and the backing roll;

a first head and a second head rotatably mounted to the frame on either side of the shoe;

a clamp ring mounted to at least the first head, wherein the clamp ring is slidable on the first head to move axially along the first head, and wherein the clamp ring has an outwardly facing inclined surface;

a plurality of clamp wedge segments mounted to the first head and radially positionable with respect to the first head, each clamp wedge segment having an inwardly facing inclined surface which engages with the outwardly facing inclined surface of the clamp ring;

a head ring fixed to the first head and having portions disposed radially outwardly of the clamp wedge segments; and means for advancing the clamp ring axially with respect to the first head to engage the plurality of clamp wedges and drive portions of the clamp wedges radially outwardly to engage the blanket against the head ring, and thereby clamp the blanket to the first head.

13. The press apparatus of claim 12 wherein each wedge segment is connected to the first head by two fasteners, wherein the fasteners extend through two parallel slots defined by portions of the first head, such that the wedge segment is slidable radially outwardly with respect to the first head, while being retained against substantial axial displacement by the fasteners.

14. The press apparatus of claim 12 wherein each wedge segment has portions defining an outwardly facing peripheral slot, and further comprising a looped extension spring which encircles all the wedge segments and urges said wedge segments into contact with the clamp ring.

15. The press apparatus of claim 12 further comprising an air tube which encircles the clamp ring, wherein the air tube is inflatable when the clamp ring is in the blanket clamped position to form a seal between the clamp ring and the blanket.

16. The press apparatus of claim 15 further comprising:

portions of the clamp ring which define an air passage which extends between the air tube and an inwardly facing generally cylindrical surface of the clamp ring;

portions of the first head which define an outwardly facing cylindrical surface adjacent the clamp ring inwardly facing cylindrical surface; and portions of the first head which define an air inlet passage which communicates between the clamp ring air passage and the first head exterior when the clamp ring is in a blanket clamped position, such that pressurized air may be introduced into the air tube from the exterior of the first head.

17. The press apparatus of claim 16 wherein the air inlet passage as it discharges to the outwardly facing generally cylindrical surface of the first head is larger in diameter than the mating air passage in the clamp ring where the air inlet passage communicates with the clamp ring air passage, thereby accommodating a range of clamped positions of the clamp ring.

18. The press apparatus of claim 12 wherein the head ring has a radially extending flange, and wherein the flange is connected to the first head by a plurality of removable fasteners.

19. The press apparatus of claim 12 further comprising a plurality of removable fasteners which extend through portions of the first head into the clamp ring, the fasteners serving to hold the clamp ring in an axial blanket clamped position, wherein the fasteners are removable to permit the clamp ring to be displaced axially to a blanket unclamped position.

20. A press apparatus comprising:

a rotatably mounted backing roll;

an elongated concave shoe, the shoe being urged toward the backing, roll to define an extended nip therebetween for the passage therethrough of a paper web;

a blanket defining an endless loop, wherein the blanket extends through the nip such that the web is disposed between the blanket and the backing roll, the blanket having a first lateral edge and a second lateral edge spaced in the cross machine direction from the first lateral edge;

at least one head mounted for rotation about an axis with respect to the shoe;

a clamp ring mounted on the head for axial displacement thereon;

portions of the clamp ring which define a wedge surface facing outwardly from the head;

a plurality of wedge segments engaged with the clamp ring wedge surface, wherein each wedge segment has an inclined surface which engages with the clamp ring wedge surface such that axial displacement of the clamp ring with respect to the head causes the simultaneous radial displacement of all wedge segments;

a generally cylindrical head ring which is substantially coaxial with the head and which has portions which encircle the wedge segments, and which is fixed to the head, wherein portions of the blanket extend between the wedge segments and the head ring, and wherein the clamp ring is selectably positionable to alternatively cause the wedge segments to fixedly clamp the blanket to the head, and to release the blanket from engagement with the head for removal from the apparatus;

means for advancing the clamp ring axially with respect to the head to engage the plurality of clamp wedges and drive portions of the clamp wedges radially outwardly to engage the blanket against the head ring, and thereby clamp the blanket to the head; and means for forming a seal between the clamped blanket and the clamp ring, the means for forming a seal being independent of and spaced from the wedge segments.

21. The press apparatus of claim 20 further comprising means for selectably locking the clamp ring in the blanket clamped position.

22. The press apparatus of claim 20 wherein the means for advancing the clamp ring further comprises a means for retracting the clamp ring to a blanket unclamped position.

23. The press apparatus of claim 20 wherein each wedge segment has portions defining an outwardly facing peripheral slot, and further comprising a looped spring which encircles all the wedge segments and urges said wedge segments into contact with the clamp ring.

24. A press apparatus comprising:

a rotatably mounted backing roll;

an elongated concave shoe, the shoe being urged toward the backing roll to define an extended nip therebetween for the passage therethrough of a paper web;

a blanket defining an endless loop, wherein the blanket extends through the nip such that the web is disposed between the blanket and the backing roll, the blanket having a first lateral edge and a second lateral edge spaced in the cross machine direction from the first lateral edge;

at least one head mounted for rotation about an axis with respect to the shoe;

a clamp ring mounted on the head for axial displacement thereon;

portions of the clamp ring which define a wedge surface facing outwardly from the head;

a plurality of wedge segments engaged with the clamp ring wedge surface, wherein each wedge segment has an inclined surface which engages with the clamp ring wedge surface such that axial displacement of the clamp ring with respect to the head causes the simultaneous radial displacement of all wedge segments;

a generally cylindrical head ring which is substantially coaxial with the head and which has portions which encircle the wedge segments, and which is fixed to the head, wherein portions of the blanket extend between the wedge segments and the head ring, and wherein the clamp ring is selectably positionable to alternatively cause the wedge segments to fixedly clamp the blanket to the head, and to release the blanket from engagement with the head for removal from the apparatus;

a plurality of pistons which are connected to the head and which extend axially, wherein the clamp ring is engaged with the pistons, and wherein introduction of fluid between the clamp ring and the pistons serves to drive the clamp ring axially with respect to the head to engage the plurality of clamp wedges and drive portions of the clamp wedges radially outwardly to engage the blanket against the head ring, and thereby clamp the blanket to the head; and an inflatable seal which extends between the clamped blanket and the clamp ring, the seal serving to retain pressure within the blanket, and wherein loss of the seal does not affect the clamping of the blanket to the heads.

25. The press apparatus of claim 24 wherein each wedge segment is connected to the head by two fasteners, and wherein the fasteners extend through two parallel slots defined by portions of the head, such that the wedge segment is slidable radially outwardly with respect to the head, while being retained against substantial axial displacement by the fasteners.

26. The press apparatus of claim 24 wherein each wedge segment has portions defining an outwardly facing peripheral slot, and further comprising a looped extension spring which encircles all the wedge segments and urges said wedge segments into contact with the clamp ring.

27. The press apparatus of claim 24 wherein portions of the clamp ring define piston cylinders, each piston cylinder opening toward and receiving a piston therein for sliding movement of the clamp ring with respect to the pistons and the head.

28. The press apparatus of claim 27 further comprising:

portions of the head which define a first groove which encircles the head and which opens on an outwardly facing generally cylindrical head surface;

portions of the clamp ring defining first passages, wherein a first passage extends from each piston cylinder to an inwardly facing generally cylindrical surface of the clamp ring, the first passages communicating with the first groove on the head; and a first hydraulic fluid inlet defined by portions of the head, the first inlet being in communication with the first groove, such that hydraulic fluid may be introduced into the first passages and the piston cylinders to act on the pistons and drive the clamp ring axially toward the wedge segments.

29. The press apparatus of claim 28 further comprising:

portions of the head defining a second groove which encircles the head and which opens on the outwardly facing generally cylindrical head surface;

portions of the clamp ring defining second passages, wherein a second passage extends from each piston cylinder to the inwardly facing generally cylindrical surface of the clamp ring, the second passages communicating with the second groove on the head; and a second hydraulic fluid inlet defined by portions of the head, the second inlet being in communication with the second groove, such that hydraulic fluid may be introduced into the second passages and the piston cylinders to act on the pistons to drive the clamp ring axially away from the wedge segments.

30. The press apparatus of claim 24 wherein the inflatable seal comprises an air tube which encircles the clamp ring and which is supplied with air from within the clamp ring, wherein the air tube is inflatable when the clamp ring is in the blanket clamped position to form a seal between the clamp ring and the blanket.

31. The press apparatus of claim 30 further comprising:

portions of the clamp ring which define an air passage which extends between the air tube and an inwardly facing generally cylindrical surface of the clamp ring;

portions of the head which define an air inlet passage which communicates between the clamp ring air passage and the head exterior when the clamp ring is in a blanket clamped position, such that pressurized air may be introduced into the air tube from the exterior of the head.

32. The press apparatus of claim 30 wherein the air inlet passage as it discharges to an outwardly facing generally cylindrical surface of the head is larger in diameter than the mating air passage in the clamp ring where the air inlet passage communicates with the clamp ring air passage, thereby accommodating a range of clamped positions of the clamp ring.

33. The press apparatus of claim 24 wherein the head ring has a radially extending flange, and wherein the flange is connected to the head by a plurality of removable fasteners.

34. The press apparatus of claim 24 further comprising a plurality of removable fasteners which extend through portions of the head into the clamp ring, the fasteners serving to hold the clamp ring in an axial blanket clamped position, wherein the fasteners are removable to permit the clamp ring to be displaced axially to a blanket unclamped position.

* * * * *